US009582982B2

(12) United States Patent
Rajala et al.

(10) Patent No.: US 9,582,982 B2
(45) Date of Patent: Feb. 28, 2017

(54) METHOD AND SYSTEM FOR ENERGY MANAGEMENT OF AN OFFENDER MONITOR

(71) Applicant: Numerex Corp., Atlanta, GA (US)

(72) Inventors: Yoganand Rajala, Alpharetta, GA (US); David Scheppegrell, Charlotte, NC (US)

(73) Assignee: NUMEREX CORP., Atlanta, GA (US)

( * ) Notice: Subject to any disclaimer, the term of this patent is extended or adjusted under 35 U.S.C. 154(b) by 274 days.

(21) Appl. No.: 14/534,746

(22) Filed: Nov. 6, 2014

(65) Prior Publication Data

US 2016/0133121 A1 May 12, 2016

(51) Int. Cl.

| | |
|---|---|
| ***G08B 1/00*** | (2006.01) |
| ***G08B 21/22*** | (2006.01) |
| ***G08B 29/18*** | (2006.01) |

(52) U.S. Cl.

CPC ..... *G08B 21/22* (2013.01); *G08B 29/181* (2013.01)

(58) Field of Classification Search

USPC ..... 340/506, 3.1, 539.1, 539.11, 573.1

See application file for complete search history.

(56) References Cited

U.S. PATENT DOCUMENTS

2011/0213216 A1* 9/2011 McKenna ..... A61B 5/0002 600/301

* cited by examiner

*Primary Examiner* — Daryl Pope

(74) *Attorney, Agent, or Firm* — King & Spalding LLP

(57) ABSTRACT

A portable device, for example an offender monitor, can utilize a GPS receiver or other location detector to provide locational information for the device. The portable device can communicate over a cellular network, for example using a radio to transmit location readings over the network. The location detector and the radio can draw power from an onboard battery. The portable device can operate in at least two modes. When charge of the battery drops below a threshold, the device can switch from the first mode of operation to the second mode to conserve power and avoid fully depleting the battery.

20 Claims, 4 Drawing Sheets

METHOD AND SYSTEM FOR ENERGY MANAGEMENT OF AN OFFENDER MONITOR

TECHNICAL FIELD

The present technology relates generally to offender monitors for tracking locations of offenders, and more particularly to changing an offender monitor's mode of operation as battery life decays.

BACKGROUND

An offender monitor can utilize a rechargeable onboard battery for power. However, if the battery's power is exhausted, a conventional offender monitor may be susceptible to tampering during a window of time before the battery is recharged. Moreover, the offender may have an opportunity to go to an impermissible location or to otherwise perform an impermissible act that would otherwise be detected and reported by the offender monitor.

Accordingly, there are needs in the art for energy management of offender monitors. For example, need exists for a technology to avoid fully depleting battery power of an offender monitor. Need further exists for preventing an offender monitor from providing an offender with a window of time during which tampering or other improper actions may go undetected. A technology addressing one or more such needs, or some related deficiency in the art, would result in benefits that may include improved offender management, for example.

SUMMARY

A portable device can comprise a location detector, for example a global positioning system (GPS) receiver, that provides locational information about the device and a radio for communicating over a cellular network. An onboard battery can power the location detector and the radio. When charge on the battery drops below a threshold, the portable device can switch operational modes to conserve energy. Switching operational modes can comprise reducing location data acquisition rate, storing monitoring data for transmission after a battery recharge, reducing functionality, reducing data transfer rate, or switching to a backup battery, to mention a few representative examples.

The foregoing discussion of power management is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1:
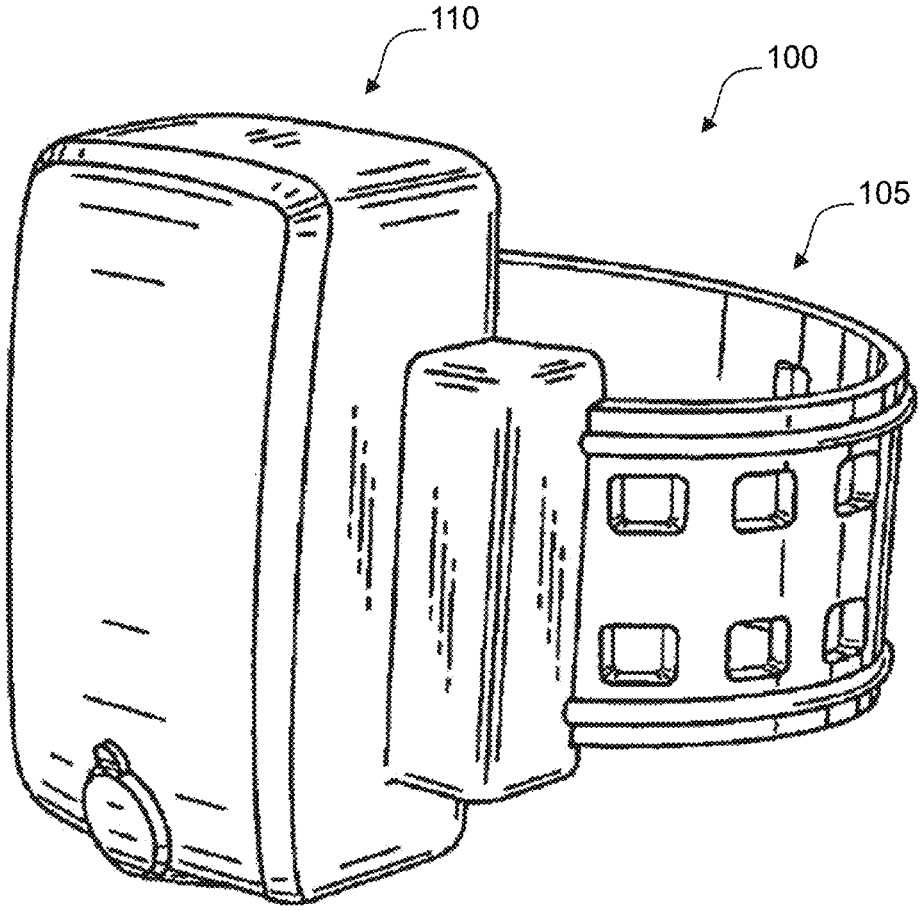
FIG. 1 is an illustration of an offender monitor in accordance with some example embodiments of the present technology.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DESCRIPTION OF EXAMPLE EMBODIMENTS

A computer-based system and process can manage energy consumption of an offender monitor. Managing energy consumption can avoid a situation in which exhaustion of the offender monitor's energy supply provides an unmonitored window of time during which an offender may perform an impermissible act that goes undetected.

Some example embodiments of the present technology will be discussed in further detail below with reference to the figures. However, the present technology can be embodied in many different forms and should not be construed as limited to the embodiments set forth herein. Rather, these embodiments are provided so that this disclosure will be thorough and complete, and will fully convey the scope of the technology to those having ordinary skill in the art. Furthermore, all "examples," "embodiments," "example embodiments," or "exemplary embodiments" given herein are intended to be non-limiting and among others supported by representations of the present technology.

Some of the embodiments may comprise or involve processes that will be discussed below. Certain steps in such processes may naturally need to precede others to achieve intended functionality or results. However, the technology is not limited to the order of the steps described to the extent that reordering or re-sequencing does not render the processes useless or nonsensical. Thus, it is recognized that some steps may be performed before or after other steps or in parallel with other steps without departing from the scope and spirit of this disclosure.

Turning now to FIG. 1, this figure illustrates an example offender monitor 100 according to some embodiments of the present technology. The illustrated offender monitor 100 provides a representative, non-limiting example, of a tracking device.

The illustrated offender monitor 100 comprises a strap 105 that extends around an appendage of an offender, for example the offender's leg or arm, who is being monitored. The strap 105 is attached to a housing 110 that encloses electrically powered elements as discussed below. The offender may be a criminal on parole or a person under a government order for monitoring, for example. In example embodiments, the illustrated offender monitor 100 can be characterized as a tracking device for monitoring the movement of an individual.

In some example embodiments, the housing 110 can enclose various components such as one or more batteries, electronic circuitry (e.g., a transceiver, GPS locating circuitry, antenna, etc.), optical devices (e.g., a light source, a light receiver, etc.) and optical connectors. Padding can optionally be provided on the back of the housing 110 to facilitate wearing the offender monitor 100 comfortably around a leg or an arm of an individual, for example.

Alternatively, the padding can be omitted. The individual can be, for example, an offender who is subject to a restraining order or house arrest from a court or other authority. One end of the strap 105 attaches to the housing 110. In installation, the other end of the strap 105 is wrapped around the individual's leg or arm and attached to the housing 110, for example using pins or other fasteners.

U.S. Pat. No. 8,115,621, issued Feb. 14, 2012 in the name of Yoganand Rajala and Steve Aninye and entitled "Device for Tracking the Movement of Individuals or Objects" discloses some example embodiments of an offender monitor 100 and is hereby incorporated herein by reference.

Figure 2:
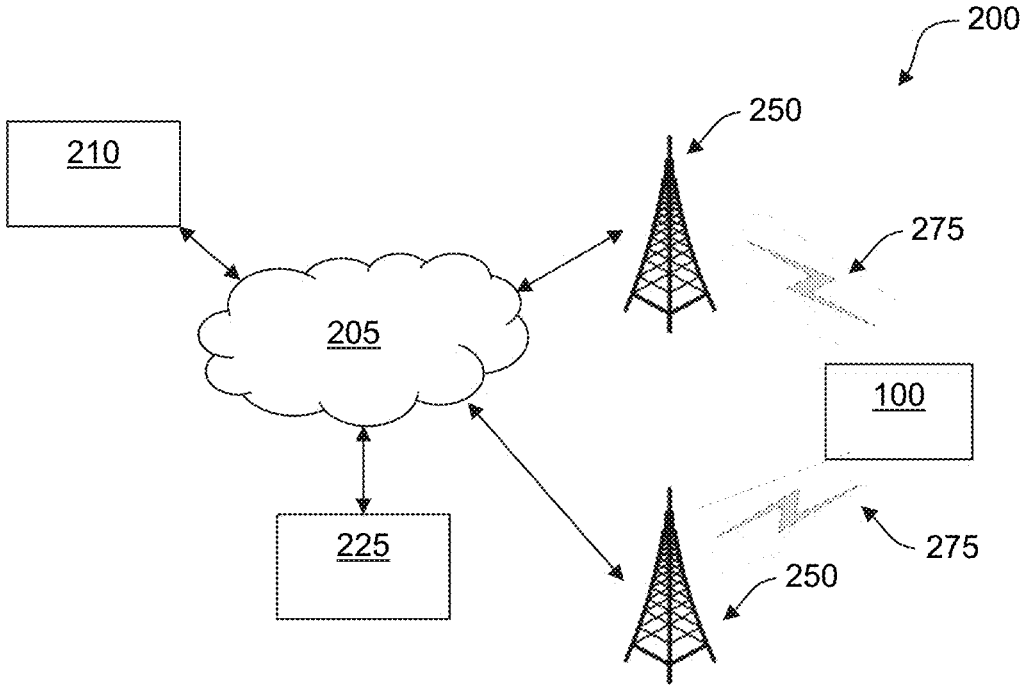
FIG. 2 is an illustration of an operating environment for an offender monitor in accordance with some example embodiments of the present technology.

Turning now to FIG. 2, this figure illustrates an example operating environment for the offender monitor 100 according to some embodiments of the present technology. In the illustrated embodiment, the operating environment comprises a cellular system 200. As illustrated, the offender monitor 100 is located near two cell towers 250 and may communicate with either via respective communication channels 275. The cell towers 250 communicate with a server 210 over a network 205. In some example embodiments, the network 205 comprises the Internet.

A user station 225 is also connected to the network 205. The user station 225 can communicate with the offender monitor 100 through the server, or alternatively directly. The user station 225 provides an interface through which a user, for example an officer such as a parole officer or official, can interact with the offender monitor 100 and the server 210. The officer may track offender movements and historical movement patterns through the user station 225, for example.

The server 210 provides location services for the offender monitor 100 as well as for other monitors (not illustrated) that may be attached to other people or objects. In an example embodiment, the server 210 typically comprises an Internet connection, a processor, and memory. In some example embodiments, the server 210 comprises a GUI and can generate geofences.

Figure 3:
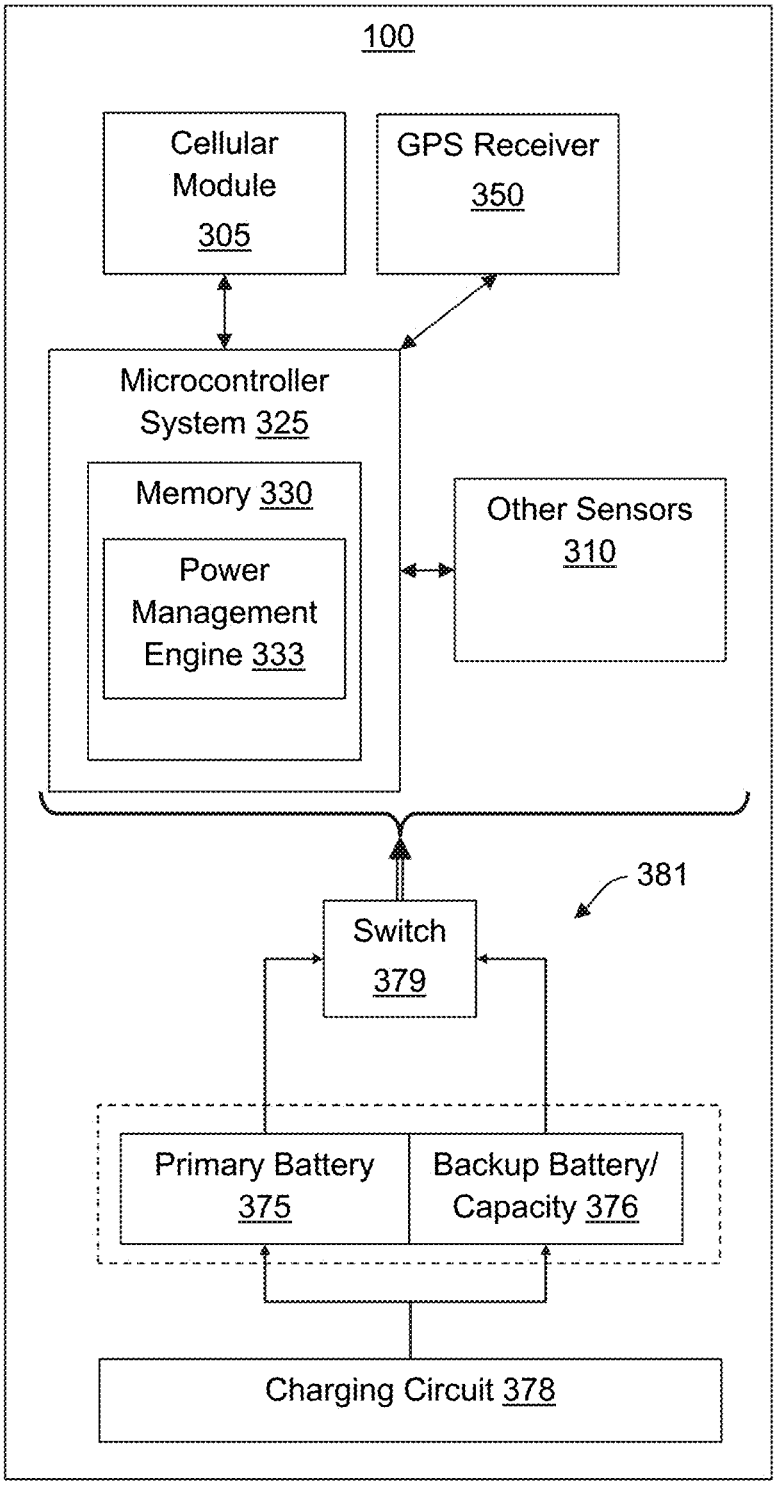
FIG. 3 is a functional block diagram of an offender monitor in accordance with some example embodiments of the present technology.

Turning now to FIG. 3, this figure illustrates a functional block diagram for the example offender monitor 100 according to some embodiments of the present technology. In the illustrated embodiment, the offender monitor 100 comprises a cellular module 305, a GPS receiver 350, a microcontroller system 325, and other sensors 310, all of which are powered by an on-board power system 381. The cellular module 305 comprises an example embodiment of a radio. The GPS receiver 350 comprises an example embodiment of a location detector.

The other sensors 310 may include tamper detectors, orientation sensors, switches, microphones, gyroscopes, accelerometers, etc. Example tamper detectors can include switches that open or close to provide an electrical signal when the housing 310 is opened or otherwise breached, fiber optic strands that are embedded in the strap 105 to break and stop transmitting an optical signal when the strap 105 is compromised, and other appropriate tamper sensing devices.

In some example embodiments, the cellular module 305 and the GPS receiver 350 are integrated into a single modem module or chip or chip set. In operation, the cellular module 305 maintains a connection to the one or more cell towers 250 over one or more wireless channels 275 through a wireless network as illustrated in FIG. 2. In an example embodiment, the cellular module 305 continuously attempts to keep a cellular connection available to the tower 250. In such an embodiment, the server 210 can control the operation of the offender monitor 100 by sending commands or other data to the monitor 100. In various embodiments, the cellular module 305 can comprise CDMA, GSM, UMTS, HSPA, or LTE technologies.

When triggered by the microcontroller system 235, a GPS location reading occurs on the GPS receiver 350. The microcontroller system 235 can further control the cellular module 305 in connection with transmitting acquired location data (GPS or otherwise), notifications, alarms, and other appropriate data and with receiving commands and other data. In some embodiments, location information is obtained utilizing cell-tower-based triangulation, such as advanced forward link trilateration (AFLT), or using a signal-strength-based location approach, such as received signal strength indicator (RSSI) based on tower or Wifi signals. The offender monitor 100 can utilize such technologies as embodiments of a location detector to augment or support, or as a substitution for, satellite-based location tracking. Further, GPS tracking can utilize assisted GPS (A-GPS) to improve location acquisition speed.

In an example embodiment, the microcontroller system 325 comprises a low-power microcontroller and associated memory 330. The microcontroller system 325 can comprise a microprocessor or other appropriate processor, for example. Example embodiments of the memory 330 can comprise volatile and nonvolatile memory, such as random access memory (RAM) and flash memory for example. In an example embodiment, the memory 330 can comprise firmware for executing management and control functions. For example, the memory 330 can comprise persistent memory that stores program code, including a power management engine 333. An example embodiment of the power management engine 333 comprises computer executable instructions for managing a battery supply, such as code for process 400 that is illustrated in flowchart form in FIG. 4 and discussed below. Accordingly, the instructions may be executed by the microcontroller system 325 or other appropriate computer-, controller-, or microprocessor-based system.

In the illustrated embodiment, the power system 381 comprises a primary battery 375 and a backup battery 376. As will be discussed further below with reference to FIG. 4, the backup battery 376 provides supplemental energy storage that the offender monitor 100 can utilize to provide a reduced level of monitoring when the primary battery 375 is exhausted or is on the verge exhaustion. In some example embodiments, a portion of the primary battery's capacity is reserved for providing limited functionality with reduced power consumption. Such reserve capacity may be substituted for the backup battery 376 or may augment or work with the backup battery 376.

In some embodiments, the primary battery 375 powers certain elements of the offender monitor 100, while both the primary battery 375 and the backup battery 376 power other elements. For example, the primary battery 375 can power elements with relatively large energy consumptions, such as the cellular module 305 and the GPS receiver 350. And, critical elements that have lower power demands, such as the microcontroller system 325 and tamper sensors, can receive power from the primary battery 375 and the backup battery 376.

A switch 379 facilitates switching between the primary battery 375 and the backup battery 376. The switch 379 may be solid state or electromechanical, for example.

A charging circuit 378 recharges the primary battery 375 and the backup battery 376 when either or both are depleted. The charging circuit 378 draws power from an external source, for example a power charging cord.

Figure 4:
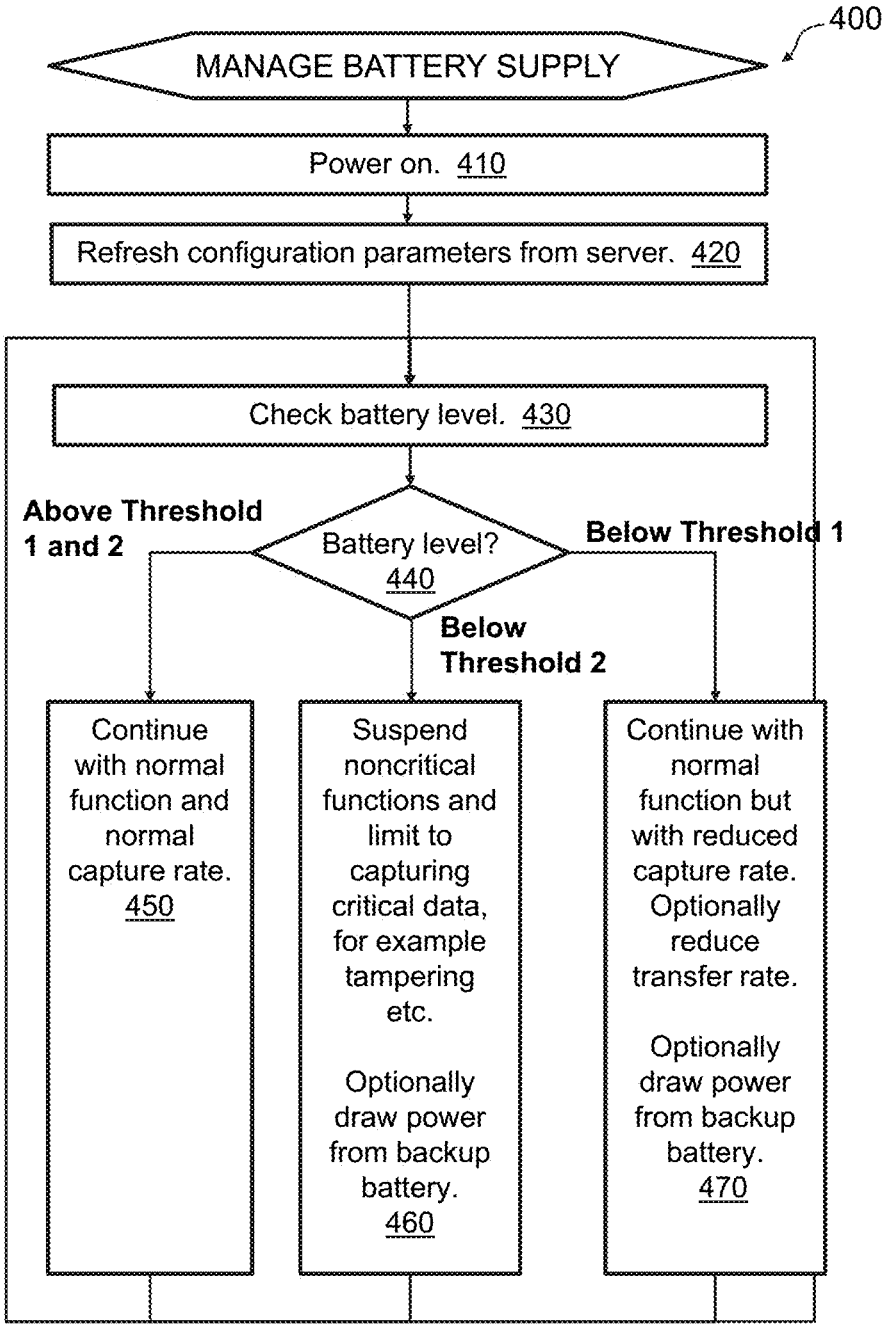
FIG. 4 is a flowchart of a process for managing a battery supply in accordance with some example embodiments of the present technology.

An example process 400 for battery supply management will now be described in further detail with reference to FIG. 4. Example reference will further be made to the preceding figures, without limitation. In some example embodiments, instructions for execution of the process 400 that FIGS. 4 illustrates in flowchart form can be stored in the memory 330 and executed by the microcontroller system 325 of the offender monitor 100, for example. As discussed above, process 400 can comprise an embodiment of the power management engine 333 maintained on the memory 330.

At block 410 of process 400, the offender monitor 100 is turned on, for example during initial installation and setup or following full battery depletion/recharge or battery replacement.

At block 420 of process 400, the offender monitor 100 refreshes its configuration parameters. The offender monitor 100 can send a message to the server 210 requesting transmission of the parameters or they can be retrieved from the memory 330, for example. Thus, if the network 205 is not available, the offender monitor 100 can utilize locally stored parameters, which may have been downloaded previously.

At block 430, the microcontroller system 325 of the offender monitor 100 checks charge level of the primary battery 375. In various embodiments, the check can entail determining the amount of energy stored in the primary battery 375 as a fraction of full capacity, as a current, as a voltage, or by other appropriate approach, for example.

At decision block 440, the microcontroller system 325 compares the charge on the primary battery 375 to one or more thresholds and branches execution according to the comparative result. In the flowcharted embodiment of FIG. 4, the comparison is made to two thresholds, which are referred to as threshold one and threshold two. In some example embodiments, threshold one is greater than threshold two. In some example embodiments, threshold one is less than threshold two. In some example embodiments, threshold one and threshold two are equal or substantially equal. In some example embodiments, the thresholds one and two are in a range of about one percent to about twenty percent of full charge.

In some example embodiments, the comparison is implemented by conducting an analog-to-digital conversion (ADC) on the battery level so that the charge level is represented as a digital number. Then, the microcontroller system 325 can make an arithmetic comparison between that digital number and two other digital numbers that represent the thresholds one and two.

In some example embodiments, the offender monitor 100 implements the comparisons using an operational amplifier (op-amp) comparator or other appropriate circuitry that compares a voltage representation of the battery level to one or more reference voltages.

In the flowcharted embodiment, if execution of block 440 results in a determination that charge on the primary battery 375 is above both thresholds, then block 450 executes. At block 450, the offender monitor 100 functions under a normal mode of operation based on the configuration parameters set at block 420. In an example embodiment, the offender monitor 100 acquires location readings (using GPS, triangulation, signal strength, or other appropriate technology) on a time interval defined in the configuration parameters. That time interval might be one minute, so that the GPS receiver takes one reading per minute, for example.

From block 450, execution of process 400 loops back to block 430. Accordingly, process 400 iterates execution of blocks 430, 440, and 450 while battery level is above-threshold and thus deemed sufficient to continue operating normally.

If execution of decision block 440 results in a determination that battery level has diminished to a level defined by threshold two, then execution of process 400 branches to block 460. At block 460, the offender monitor 100 transitions to a mode of energy conservation in which one or more noncritical functions are suspended. The diminished functionality reduces energy consumption to avoid fully depleting available energy. In an example embodiment, the microcontroller system 325 ceases location data acquisition but continues monitoring for tamper events, such as opening of the offender monitor housing 110, unauthorized removal of the strap 105, or severing of the strap 105. In the event of tamper detection, the cellular module 305 of the offender monitor 100 may immediately transmit an alarm to the server 210. Alternatively, the offender monitor 100 may store a record of a tamper event in the memory 330 for transmission at a later time when sufficient battery power is available.

In some example embodiments, block 460 executes utilizing power from the backup battery 376. In this case, execution of block 460 can comprise the microcontroller system 325 triggering the switch 379 to switch from the primary battery 375 to the backup battery 376. In some example embodiments, block 460 executes utilizing remaining energy in the primary battery 375 or a reserve portion of the primary battery 375. In some embodiments, the microcontroller system 325 can completely turn off power to the cellular module 305, the GPS receiver 350, and any other noncritical power consuming hardware.

Following execution of block 460, process 400 loops back to block 430 and continues.

If execution of decision block 440 results in a determination that battery level has diminished to a level defined by threshold three, then execution of process 400 branches to block 470. At block 470, the offender monitor 100 transitions to a mode of energy conservation in which the rate of location data acquisition is reduced. Thus, the time between data acquisitions can be extended so that the GPS receiver 350 consumes less energy. Additionally, the location data that is acquired can be stored in the memory 330 for transmission at a later time when sufficient battery power is available, for example after a battery recharge. In this manner, the offender monitor 100 mitigates the possibility of an offender moving to an impermissible location during a gap in monitoring due to battery charge depletion. In some embodiments, the rate of transferring location data from the offender monitor 100 can be reduced.

In some example embodiments, block 470 executes utilizing power from the backup battery 376. In this case, execution of block 470 can comprise the microcontroller system 325 utilizing the switch 379 to switch from the primary battery 375 to the backup battery 376. In some example embodiments, block 470 executes utilizing remaining energy in the primary battery 375 or a reserve portion of the primary battery 375.

Following execution of block 470, process 400 loops back to block 430 and executes.

The flowcharted embodiment of example process 400 accommodates branching three ways from decision block 440. However, in some embodiments, only two of the branches may be available or active. Thus in some embodiments, battery level change causes the offender monitor 100 to operate in the normal mode of block 450 or the energy-conservation mode of block 460 in which at least one noncritical function is suspended, but not in the energy-conservation mode of reduced capture rate of block 470. Similarly, based on battery level, the offender monitor 100 may switch between operating in the normal mode of block 450 and operating in the mode of block 470 in which GPS capture rate is reduced to conserve energy.

In some embodiments, process 400 may execute a decision from block 440 to suspend noncritical functions and to reduce the rate of location data acquisition.

Technology for energy management has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. An offender monitor comprising:
a battery;
a location detector;
a radio;
a processor that is powered by the battery and that comprises:
a connection to the location detector;
a connection to the radio; and
memory; and
processor executable instructions stored in the memory to perform the steps of:
comparing level of the battery to a threshold;
if the level of the battery is above the threshold, then acquiring location data at a first rate; and
if the level of the battery is below the threshold, then acquiring location data at a second rate that is less than the first rate,
wherein acquiring location data at a second rate that is less than the first rate comprises drawing power from a reserve portion of the battery.

2. An offender monitor comprising:
a battery;
a location detector;
a radio;
a processor that is powered by the battery and that comprises:
a connection to the location detector;
a connection to the radio; and
memory; and
processor executable instructions stored in the memory to perform the steps of:
comparing level of the battery to a threshold;
if the level of the battery is above the threshold, then acquiring location data at a first rate; and
if the level of the battery is below the threshold, then acquiring location data at a second rate that is less than the first rate,
the offender monitor further comprising a second battery,
wherein the processor executable instructions stored in the memory are further to perform the step of
if the level of the battery is below the threshold, then switching to the second battery.

3. An offender monitor comprising:
a battery;
a location detector;
a radio;
a processor that is powered by the battery and that comprises:
a connection to the location detector;
a connection to the radio; and
memory; and
processor executable instructions stored in the memory to perform the steps of:
comparing level of the battery to a threshold;
if the level of the battery is above the threshold, then acquiring location data at a first rate; and
if the level of the battery is below the threshold, then acquiring location data at a second rate that is less than the first rate,
wherein the processor executable instructions stored in the memory are further to perform the step of
if the level of the battery is below the threshold, then suspending location data acquisitions while continuing to monitor for tampering.

4. An offender monitor comprising:
a battery;
a location detector;
a radio;
a processor that is powered by the battery and that comprises:
a connection to the location detector;
a connection to the radio; and
memory; and
processor executable instructions stored in the memory to perform the steps of:
comparing level of the battery to a threshold;
if the level of the battery is above the threshold, then acquiring location data at a first rate; and
if the level of the battery is below the threshold, then acquiring location data at a second rate that is less than the first rate,
wherein the processor executable instructions stored in the memory are further to perform the steps of:
comparing the level of the battery to a second threshold; and
if the level of the battery is below the second threshold, then suspending location data acquisitions while continuing to monitor for tampering.

5. The offender monitor of claim 1, wherein the offender monitor further comprises:
a housing in which the battery, the location detector, the radio, and the processor are disposed; and
a strap that is sized for attaching the housing to an appendage of an offender.

6. An offender monitor comprising:
a battery;
a location detector;
a radio;
a processor that is powered by the battery and that comprises:
a connection to the location detector;
a connection to the radio; and
memory; and
processor executable instructions stored in the memory to perform the steps of:
comparing level of the battery to a threshold;
if the level of the battery is above the threshold, then acquiring location data and monitoring for tampering; and
if the level of the battery is below the threshold, then suspending the acquiring of location data while continuing to monitor for tampering, wherein suspending the acquiring of location data while continuing to monitor for tampering comprises transmitting a notification if a tampering event is detected.

7. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

comparing level of the battery to a threshold;

if the level of the battery is above the threshold, then acquiring location data and monitoring for tampering; and if the level of the battery is below the threshold, then suspending the acquiring of location data while continuing to monitor for tampering, wherein suspending the acquiring of location data while continuing to monitor for tampering comprises drawing power from a reserve portion of the battery.

8. An offender monitor comprising:

a battery;

a location detector;

a radio;

processor that is powered by the battery and that comprises:

a connection to the location detector;

a connection to the radio; and memory; and processor executable instructions stored in the memory to perform the steps of:

comparing level of the battery to a threshold;

if the level of the battery is above the threshold, then acquiring location data and monitoring for tampering; and if the level of the battery is below the threshold, then suspending the acquiring of location data while continuing to monitor for tampering, wherein suspending the acquiring of location data while continuing to monitor for tampering comprises switching from receiving power from the battery to receiving power from a second battery that the offender monitor comprises.

9. The offender monitor of claim 6, wherein the offender monitor further comprises:

a housing in which the battery, the location detector, the radio, and the processor are disposed; and a strap that is sized for attaching the housing to an appendage of an offender.

10. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

comparing level of the battery to a threshold;

if the level of the battery is above the threshold, then acquiring location data and monitoring for tampering; and if the level of the battery is below the threshold, then suspending the acquiring of location data while continuing to monitor for tampering, wherein the processor executable instructions stored in the memory are further to perform the steps of:

comparing battery level to a second threshold;

if the level of the battery is below the second threshold, then reducing location data acquisition rate.

11. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

comparing level of the battery to a threshold;

if the level of the battery is above the threshold, then acquiring location data and monitoring for tampering; and if the level of the battery is below the threshold, then suspending the acquiring of location data while continuing to monitor for tampering, wherein suspending the acquiring of location data while continuing to monitor for tampering comprises storing tampering data in the memory for transmission after the battery is recharged.

12. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

determining whether charge of the battery meets a threshold;

if the charge of the battery meets the threshold, then operating the offender monitor in a first mode; and if the charge of the battery does not meet the threshold, then operating the offender monitor in a second mode, wherein operating in the second mode consumes less power than operating in the first mode, and wherein operating the offender monitor in the second mode comprises operating with a level of functionality that is reduced relative to the first mode.

13. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

determining whether charge of the battery meets a threshold;

if the charge of the battery meets the threshold, then operating the offender monitor in a first mode; and if the charge of the battery does not meet the threshold, then operating the offender monitor in a second mode, wherein operating in the second mode consumes less power than operating in the first mode, wherein operating the offender monitor in the first mode comprises causing the location detector to obtain a first number of location readings per an amount of time, and wherein operating the offender monitor in the second mode comprises causing the location detector to obtain a second number of location readings per the amount of time, wherein the second number is less than the first number.

14. The offender monitor of claim 13, wherein the first number and the second number are greater than zero.

15. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

determining whether charge of the battery meets a threshold;

if the charge of the battery meets the threshold, then operating the offender monitor in a first mode; and if the charge of the battery does not meet the threshold, then operating the offender monitor in a second mode, wherein operating in the second mode consumes less power than operating in the first mode, wherein operating the offender monitor in the first mode comprises drawing power from the battery, and wherein operating the offender monitor in the second mode comprises drawing power from a second battery that the offender monitor comprises.

16. An offender monitor comprising:

a battery;

a location detector;

a radio;

a processor that is powered by the battery and that comprises:

a connection to the location detector;

a connection to the radio; and memory; and processor executable instructions stored in the memory to perform the steps of:

determining whether charge of the battery meets a threshold;

if the charge of the battery meets the threshold, then operating the offender monitor in a first mode; and if the charge of the battery does not meet the threshold, then operating the offender monitor in a second mode, wherein operating in the second mode consumes less power than operating in the first mode, wherein operating the offender monitor in the first mode comprises drawing power from the battery, and wherein operating the offender monitor in the second mode comprises drawing power from a reserve portion of the battery.

17. The offender monitor of claim 12, wherein operating the offender monitor in the first mode comprises acquiring location data and monitoring for tampering, and wherein operating the offender monitor in the second mode comprises suspending the acquiring of location data while continuing to monitor for tampering.

18. The offender monitor of claim 12, wherein the offender monitor further comprises:

a housing in which the battery, the location detector, the radio, and the processor are disposed; and a strap that is sized for attaching the housing to an appendage of an offender.

19. The offender monitor of claim 13, wherein the offender monitor further comprises:

a housing in which the battery, the location detector, the radio, and the processor are disposed; and a strap that is sized for attaching the housing to an appendage of an offender.

20. The offender monitor of claim 10, wherein the offender monitor further comprises:

a housing in which the battery, the location detector, the radio, and the processor are disposed; and a strap that is sized for attaching the housing to an appendage of an offender.

* * * * *